United States Patent [19]

Broze

[11] Patent Number: 4,889,651

[45] Date of Patent: Dec. 26, 1989

[54] ACETYLATED SUGAR ETHERS AS BLEACH ACTIVATORS AND DETERGENCY BOOSTERS

[75] Inventor: Guy Broze, Grace-Hollogne, Belgium

[73] Assignee: Colgate-Palmolive Company, New York, N.Y.

[21] Appl. No.: 146,470

[22] Filed: Jan. 21, 1988

[51] Int. Cl.[4] ..... C11D 3/22; C11D 3/395

[52] U.S. Cl. ..... 252/95; 252/99; 252/174.17; 252/174.18; 252/174.21; 252/186.38; 252/DIG. 14; 536/18.3; 536/18.6

[58] Field of Search ..... 252/99, 95, 174.17, 252/174.18, 186.38, 186.4, 8.9, 174.21, DIG 14; 536/18.3, 18.6, 4.1

[56] References Cited

U.S. PATENT DOCUMENTS

| | | | |
|---|---|---|---|
| 2,955,905 | 10/1960 | Davies et al. | 8/111 |
| 2,974,134 | 3/1961 | Pollitzer | 260/209 |
| 3,219,656 | 11/1965 | Boettner | 252/174.17 |
| 3,737,426 | 6/1973 | Throckmolton | 260/210 R |
| 3,772,269 | 11/1973 | Lew | 260/210 R |
| 3,919,107 | 11/1975 | Thompson | 252/99 |
| 4,088,596 | 5/1978 | Arai et al. | 252/99 |
| 4,422,950 | 12/1983 | Kemper et al. | 252/186.38 |
| 4,493,773 | 1/1985 | Cook | 252/8.8 |
| 4,648,983 | 3/1987 | Broze et al. | 252/135 |
| 4,663,444 | 5/1987 | Egan | 536/4.1 |

FOREIGN PATENT DOCUMENTS 2304057 8/1973 Fed. Rep. of Germany .

*Primary Examiner*—Prince E. Willis
*Assistant Examiner*—Kathleen Markowski
*Attorney, Agent, or Firm*—Norman Blumenkopf; Robert C. Sullivan; Murray Grill

[57] ABSTRACT

A heavy duty detergent composition having incorporated therein an acetylated sugar ether which provides bleach activation and detergency boosting properties to the detergent composition. The acetylated sugar ether contains a long-chain alkyl group. The acetylated sugar ether acts as a bleach activator by reacting with a bleaching agent, such as sodium perborate monohydrate, to generate peracetic acid. Following perhydrolysis, the compound acts as a detergency booster.

13 Claims, No Drawings

ACETYLATED SUGAR ETHERS AS BLEACH ACTIVATORS AND DETERGENCY BOOSTERS

BACKGROUND OF THE INVENTION (1) Field of the Invention

This invention relates to an improved heavy duty laundry detergent composition. More particularly, the invention is directed to a heavy duty detergent composition having incorporated therein an acetylated sugar ether which provides bleach activating and detergency boosting properties to the detergent composition. A preferred embodiment of the invention is directed to a non-aqueous liquid heavy duty laundry detergent composition having both activated bleach and activated detergency.

(2) Description of the Prior Art

The use of various sugar derivatives in laundry detergent compositions is known.

It is well known in the art that certain alkyl glycosides, particularly long chain alkyl glycosides, are surface active and are useful as nonionic surfactants in detergent compositions. Lower alkyl glycosides are not as surface active as their long chain counterparts. Alkyl glycosides exhibiting the greatest surface activity have relatively long-chain alkyl groups. These alkyl groups generally contain about 8 to 25 carbon atoms and preferably about 10 to 14 carbon atoms.

Long chain alkyl glycosides are commonly prepared from saccharides and long chain alcohols. However, unsubstituted saccharides such as glucose are insoluble in higher alcohols and thus do not react together easily. Therefore, it is common to first convert the saccharide to an intermediate, lower alkyl glycoside which is then reacted with the long chain alcohol. Lower alkyl glycosides are commercially available and are commonly prepared by reacting a saccharide with a lower alcohol in the presence of an acid catalyst. Butyl glycoside is often employed as the intermediary.

The use of long chain alkyl glycosides as a surfactant in detergent compositions and various methods of preparing alkyl glycosides is disclosed, for example, in U.S. Pat. Nos. 2,974,134; 3,547,828; 3,598,865 and 3,721,633. The use of lower alkyl glycosides as a viscosity reducing agent in aqueous liquid and powdered detergents is disclosed in U.S. Pat. No. 4,488,981.

Acetylated sugar esters, such as, for example, glucose penta acetate, glucose tetra acetate and sucrose octa acetate, have been known for years as oxygen bleach activators. The use of acetylated sugar derivatives as bleach activators is disclosed in U.S. Pat. Nos. 2,955,905; 3,901,819 and 4,016,090.

SUMMARY OF THE INVENTION

In accordance with the present invention, a highly detersive heavy duty nonionic laundry detergent composition is prepared by the incorporation of an acetylated sugar ether into a nonionic detergent composition. The acetylated sugar ethers act as bleach activators, detergency boosters and fabric softeners. The acetylated sugar ethers may be incorporated into detergent compositions which may be formulated into liquid or powdered form. Both powdered aqueous and non-aqueous liquid formulations may advantageously be produced although far greater benefits are derived when used in a non-aqueous detergent composition.

There is no disclosure in the prior art of the use of sugar based surfactants, that is, sugar esters and sugar ethers, as detergency boosters, of the use of sugar ethers as bleach stable detergency boosters or of the use of acetylated sugar ethers as detergency boosters and bleach activators.

DETAILED DESCRIPTION OF THE INVENTION

Optimum grease/oil removal is achieved where the nonionic surfactant has an HLB (hydrophilic-lipophilic balance) of from about 9 to about 13, particularly from about 10 to about 12, good detergency being related to the existence of rod-like micelles which exhibit a high oil uptake capacity. Optimal detergency for a given nonionic surfactant is obtained between the cloud point temperature, the temperature at which a phase rich in nonionic surfactant separates in the wash solution, (CPT) and the phase inversion (coalescence) temperature (PIT). Within this narrow temperature range or window there exists a water rich microemulsion domain containing a high oil/surfactant ratio. This window varies from one nonionic detergent to another. It is about 30° C. (37°-65° C.) for a C-13 secondary fatty alcohol ethoxylated with an average of 7 ethylene oxide chains and is much smaller, about 10° C. (33°-37° C.) for an ethoxylated-propoxylated fatty alcohol. Ideally, since a heavy duty detergent must perform from low temperatures (30° C.) to high temperatures (90° C.), the CPT should not be above 30° to 40° C. and the PIT should not be below 90° C.

The existence of both a CPT and a PIT are related to the unique character of the polyethylene oxide chain. The chain monomeric element can adopt two configurations, a transconfiguration, and a gauche, cis-type configuration. The enthalpy difference between both configurations is small, but the hydration is very different. The trans-configuration is the most stable, and is easily hydrated. The gauche configuration is somewhat higher in energy and does not become hydrated to any significant extent. At low temperature the trans-configuration is preponderant and the polymeric chain is soluble in water. As temperature rises kT becomes rapidly greater than the enthalpy difference between configurations and the proportion of guache configurated monomeric units increases. Rapidly, the number of hydration water molecules drops, and the polymer solubility decreases.

The nonionic surfactant which exhibits a PIT close to the CPT is accordingly very temperature sensitive. One way to reduce the temperature sensitivity is to use a nonionic surfactant with a hydrophilic part different from polyethylene oxide. However, since commercially available nonionic surfactants are based on polyethylene oxide, the only cost effective route is to add a cosurfactant which can co-micellize, giving less temperature sensitive mixed micelles.

Various types of cosurfactant systems are known in the prior art, some of which include nonionic detergents and tertiary amide oxides or amphoteric detergents. Amphoterics have been known for years for their detergency boosting properties. One amphoteric detergent used as a cosurfactant and which has particularly good detergency boosting activity in combination with a nonionic detergent are betaine detergents and alkyl bridged betaine detergents having the general formuli

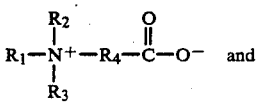

and

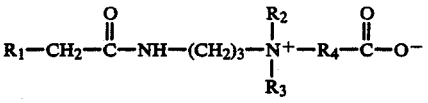

respectively, wherein $R_1$ is an alkyl radical containing from about 10 to about 14 carbon atoms; $R_2$ and $R_3$ are each selected from the group consisting of methyl and ethyl radicals; and $R_4$ is selected from the group consisting of methylene, ethylene and propylene radicals.

A suitable betaine surfactant is

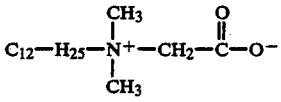

whereas a suitable alkylamidobetaine is

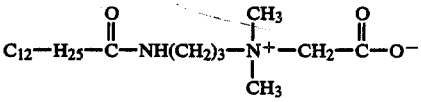

Sulfobetaines, such as

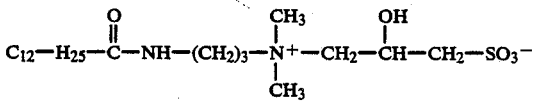

have also been found to exhibit good detergency boosting properties when used in combination with nonionic detergents.

A betaine exhibits both a positive charge and a negative charge. It is electrically neutral as are nonionic surfactants. The quarternary ammonium is essential to maintain the positive charge even in alkaline solution. It is well known that ions are easily hydrated and that the hydration does not vary much with temperature. Betaine surfactants can accordingly be used as a cosurfactant. In addition, although free amines react rapidly with peracids to give amine oxides which consume bleach moieties and surfactant molecules, a betaine is the only nitrogen containing structure which is stable in the presence of an organic peracid (present as is or generated by reaction between perborate and a bleach activator such as TAED).

The addition of betaine to a nonionic detergent significantly improves oily soil removal. Although the most significant improvement is achieved at 90° C., important benefits are obtained at 60° C. and especially at 40° C. However, on an industrial scale, betaines are only available in aqueous solution and hence cannot be used as an additive in non-aqueous liquid detergent compositions.

Detergency boosting properties have not previously been disclosed for sugar esters and sugar ethers. Potentiating or synergestic effects between sugar esters and nonionic surfactants have now been discovered and are disclosed in copending, commonly assigned application Ser. No. (IR-304/925F), filed on the same day as the subject application and titled "Sugar Esters As Detergency Boosters". In addition, it has also now been discovered, as disclosed in copending commonly assigned application Ser. No. (IR-316/940F), filed on the same day as the subject application and titled "Sugar Ethers As Bleach Stable Detergency Boosters", that sugar ethers may advantageously be used as a bleach stable detergency booster in a nonionic detergent composition. The disclosures of these patent applications are incorporated herein by reference. These sugar based surfactants have been found to be effective detergency boosters and can efficiently replace betaines, as a cosurfactant, in nonionic detergents. Sugar ethers and esters have been found to perform similar to betaines in both powdered and aqueous liquid heavy duty laundry detergents. However, unlike betaine detergents, sugar esters and sugar ethers may be advantageously employed in non-aqueous liquid detergent compositions and have been found to have significant detergency boosting efficiency in non-aqueous liquid laundry detergents. Non-aqueous liquid detergents are known as having poor detergency at high temperatures due to the presence of low phase inversion temperature nonionic. Sugar esters and sugar ethers have been found to increase the detergency of non-aqueous liquid detergents, especially at temperatures of 60° C. and above, a temperature range where non-aqueous detergent products are known to be less efficient.

Such effects are due to the fact that the hydrophilic part of the surfactant (sugar) is not significantly temperature sensitive and remains water soluble at higher temperatures. Although the solubility in water of the ethylene oxide chain diminishes as temperature rises, the presence of the —OH group in the sugar moiety significantly decreases the whole surfactant temperature sensitivity so the mixed micelle (nonionic and sugar ester/ether) remains stable in a wider temperature range than the micelle of the nonionic detergent alone.

Food grade 100% active sugar esters were tested for their detergency boosting properties. Glucose ester S 1670, a stearic acid derivative having an HLB of 16 and glucose ester L 1570, a lauric acid derivative having an HLB of 15 were each tested using EMPA and KREFELD as soils at isothermal wash temperatures of 40° C., 60°, and 90° C. In the following test, soiled cotton fabric swatches were washed for a period of 30 minutes in a wash solution containing 1.5 g TPP (sodium tripolyphosphate) and 2 g of surfactant mixture in 600 ml of tap water. The following surfactant mixtures A, B, and C were tested.

Surfactant A=nonionic surfactant (ethoxylated-propoxylated $C_{13}$–$C_{15}$ fatty alcohol)

Surfactant B=Surfactant A+L 1570

Surfactant C=Surfactant A+S 1670

Table 1 shows the detergency results of various nonionic surfactant:sugar ester ratios.

TABLE 1

SUGAR ESTER DETERGENCY

| Surfactant Mixture | Ratio of nonionic to sugar ester | Isothermic 40° C. | wash 60° C. | temperature 90° C. |
|---|---|---|---|---|
| | | Soil - EMPA on cotton | | |
| | | Delta Rd Value | | |
| A | | 18.2 | 17.7 | 6.4 |
| B | 9:1 | 18.8 | 17.1 | 10.2 |
| | 8:2 | 19.6 | 16.6 | 16.7 |

TABLE 1-continued

| Surfactant Mixture | Ratio of nonionic to sugar ester | Isothermic 40° C. | wash 60° C. | temperature 90° C. |
|---|---|---|---|---|
| SUGAR ESTER DETERGENCY | | | | |
| | 7:3 | 20.1 | 20.5 | 16.9 |
| C | 9:1 | 19.2 | 20.1 | 16.2 |
| | 8:2 | 7.3 | 13.4 | 14.2 |
| Soil - KREFELD on cotton | | | | |
| | | Delta Rd Value | | |
| A | | 4.6 | 11.4 | 11.4 |
| B | 9:1 | 4.5 | 11.9 | 12.0 |
| | 8:2 | 4.9 | 13.2 | 13.6 |
| | 7:3 | 5.9 | 13.3 | 14.3 |
| C | 9:1 | 5.5 | 11.5 | 13.2 |
| | 8:2 | 7.3 | 13.4 | 14.2 |

Table 2 shows the detergency results for different nonionic surfactant/glucose ether (alkyl glucoside) ratios wherein the alkyl glucoside, a 100% active powder, is a $C_{12}$–$C_{14}$ glucose ether (mixture of mono- and dialkyl).

The surfactant mixture was tested using, as solids, EMPA and KREFELD, at isothermal wash temperatures of 40° C., 60° C. and 90° C. In the following test, soiled cotton fabric swatches were washed for a period of 30 minutes in a wash solution containing 1.5 g TPP and 2 g of the surfactant mixture in 600 ml of tap water.

TABLE 2

| Surfactant Mixture | Ratio of nonionic to sugar ether | Isothermal 40° C. | wash 60° C. | temperature 90° C. |
|---|---|---|---|---|
| SUGAR ETHER DETERGENCY | | | | |
| Soil - EMPA on cotton | | | | |
| | | Delta Rd Value | | |
| nonionic | | 18.5 | 20.6 | 15.6 |
| nonionic/alkyl glucoside | 9.1 | 18.4 | 22.6 | 22.0 |
| | 8:2 | 20.4 | 23.4 | 24.4 |
| | 7:3 | 21.6 | 22.5 | 26.9 |
| Soil - KREFELD on cotton | | | | |
| | | Delta Rd Value | | |
| nonionic | | 8.1 | 13.1 | 12.2 |
| nonionic/alkyl glucoside | 9:1 | 9.4 | 13.2 | 15.5 |
| | 8:2 | 10.0 | 14.9 | 16.4 |
| | 7:3 | 10.7 | 15.8 | 17.5 |

From the above tables, the excellent performances of sugar esters and sugar ethers as a cosurfactant with a nonionic surfactant is clearly evidenced. Although delivering a benefit at 40° C., detergency is greatly increased at 90° C. Since the detergency of non-aqueous liquid detergents based on ethoxylated-propoxylated fatty alcohol nonionic surfactants drop at high temperatures due to the reduced solubility of the surfactant as temperature rises, the addition of a sugar fatty ester or ether as a cosurfactant greatly increases detergency.

Any sugar ester or sugar ether may be used as a potential detergency booster. It is to be understood that the nature of the hydrophilic head group can be extended to any sugar derivative such as, for example, glucose or sucrose and variations and optimizations will be apparent to those skilled in the art. Unlike polyethyleneoxide based nonionic surfactants, the HLB of sugar derivatives is adjusted by the number of hydrocarbon chains per sugar unit rather than by the hydrophilic chain length. Sugar esters and ethers may be incorporated into any detergent composition, liquid or powdered, containing a high level of nonionic surfactant.

In terms of chemical stability, sugar esters are subject to hydrolysis under alkaline conditions although saponification has not been evidenced in the washing medium in the presence of 2.5 g/liter TPP, even at 90° C. In addition, the ester bond is not stable in the presence of bleaching agents.

The use of bleaching agents as aids in laundering is well known. Of the many bleaching agents used for household applications, the chlorine-containing bleaches are most widely used at the present time. However, chlorine bleach has the serious disadvantage of being such a powerful bleaching agent that it causes measurable degradation of the fabric and can cause localized over-bleaching when used to spot-treat a fabric undesirably stained in some manner. Other active chlorine bleaches, such as chlorinated cyanuric acid, although somewhat safer than sodium hypochlorite, also suffer from a tendency to damage fabric and cause localized over-bleaching. For these reasons, chlorine bleaches can seldom be used on amide-containing fibers such as nylon, silk, wool and mohair. Furthermore, chlorine bleaches are particularly damaging to many flame retardant agents which they render ineffective after as little as five launderings.

Of the two major types of bleaches, oxygen-releasing and chlorine-releasing, the oxygen bleaches, sometimes referred to as non-chlorine bleaches or "all-fabric" bleaches, are more advantageous to use in that oxygen bleaching agents are not only highly effective in whitening fabrics and removing stains, but they are also safer to use on colors. They do not attack fluorescent dyes commonly used as fabric brighteners or the fabrics to any serious degree and they do not, to any appreciable extent, cause yellowing of resin fabric finishes as chlorine bleaches are apt to do. Both chlorine and non-chlorine bleaches use an oxidizing agent, such as sodium hypochlorite in the case of chlorine bleaches and sodium perborate in the case of non-chlorine bleaches, that reacts with and, with the help of a detergent, lifts out a stain.

Among the various substances which may be used as oxygen bleaches, there may be mentioned hydrogen peroxide and other per compounds which give rise to hydrogen peroxide in aqueous solution, such as alkali metal persulfates, perborates, percarbonates, perphosphates, persilicates, perpyrophophates, peroxides and mixtures thereof.

Although oxygen bleaches are not, as deleterious to fabrics, one major drawback to the use of an oxygen bleach is the high temperature and high alkality necessary to efficiently activate the bleach. Because many home laundering facilities, particularly in the United States, employ quite moderate washing temperatures (20° C., to 60° C.), low alkalinity and short soaking times, oxygen bleaches when used in such systems are capable of only mild bleaching action. There is thus a great need for substances which may be used to activate oxygen bleach at lower temperatures.

Various activating agents for improving bleaching at lower temperatures are known. These activating agents are roughly divided into three groups, namely (1) N-acyl compounds such as tetracetylethylene diamine (TAED), tetraacetylglycoluril and the like; (2) acetic acid esters of polyhydric alcohols such as glucose penta acetate, sorbitol hexacetate, sucrose octa acetate and the like; and (3) organic acid anhydrides, such as phthalic anhydride and succinic anhydride. The preferred bleach activator being TAED. Oxygen bleach activators, such as TAED function non-catalytically by co-reaction with the per compound to form peracids, such as peracetic acid from TAED, or salts thereof which react more rapidly with oxidizable compounds than the per compound itself.

As stated above, sugar esters are not stable in the presence of oxygen bleaches. When sodium perborate dissolves in water, hydrogen peroxide appears rapidly. Due to the alkalinity (pH 9.5–10), hydrogen peroxide, which is much more acidic than water, is ionized to a significant extent. In addition, the perhydroxyl anion is much more nucleophilic than the hydroxyl ion. During the wash cycle, the ester bond, stable enough to hydroxyl ion, even at 90° C., is rapidly perhydrolyzed at low temperatures by the hydrogen peroxide coming from perborate. Fatty peracid (e.g. perstearic acid in the above stearic acid based sugar ether) is generated but the detergency benefit is lost This mechanism is the same as the production of peracetic acid at low temperature from TAED and sodium perborate. Thus, as disclosed in the prior art, sugar esters are bleach activators although the result of bleach activation by sugar esters is much less than that with TAED because the activated bleaching moiety is perstearic acid rather than peracetic acid. Thus, sugar esters are most advantageously employed as a detergency booster in a non-aqueous liquid laundry detergent composition only when sodium perborate is removed. However, the use of a nonaqueous liquid detergent without bleach is not realistic, even if its detergency is outstanding.

As disclosed in copending commonly assigned application Ser. No. (IR-316/940F) sugar ethers not only have detergency boosting properties, but are stable in the presence of bleach. As with sugar esters, sugar ethers provide activated detergency when incorporated into both powdered and liquid detergent compositions. However, the use of sugar ethers are particularly advantageous when incorporated into non-aqueous liquid formulations. It has been discovered that alkyl glycosides (e.g. glucose ether) exhibit very efficient detergency boosting properties especially with low foam surfactants, such as ethoxylated-propoxylated fatty alcohols. The ether bond being perfectly stable against hydrolysis and perhydrolysis.

Although sugar ethers are similar to sugar esters in detergent performance, they are, unlike sugar esters, stable against alkalinity and hydrogen peroxide. Any sugar ether can potentially deliver this type of benefit. In addition, any stable link between the sugar moiety and the fatty acid chain can be used. Such linkages include, but are not limited to, amide, thioether and urethane linkages which may be formed by conventional reactions. In addition to their very high efficiency, sugar ethers are very stable against chemical degradation. The incorporation of a sugar ether in a liquid or powdered heavy duty detergent efficiently replaces betaines or sugar esters as the cosurfactant with a nonionic detergent.

Applicant have now discovered and herein claims the use of acetylated sugar ethers in nonionic detergent compositions. The acetylated sugar ethers act as bleach activators and detergency boosters. The acetylated sugar has the general formula

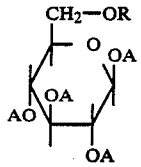

wherein R represents a fatty chain containing at least 10 carbon atoms and A represents —CO—$CH_3$.

The incorporation of the above acetylated sugar ether in a liquid or powdered detergent efficiently replaces both TAED as a bleach activator and the cosurfactant betaine or sugar ester/ether as the detergency booster.

In the preparation of the above molecule a classical long-chain alkyl glycoside (sugar ether) containing at least 10 carbon atoms in the alkyl chain, preferably 12 to 22 carbon atoms, produced by methods known in the art, is acetylated by reaction with acetic anhydride. Following purification, the product can be incorporated into the detergent composition.

When water is added (i.e. the composition is added to the wash water), the compound reacts first with perborate and generates peracetic acid. After reaction with hydrogen peroxide, the compound acts as a detergency booster.

Although acetylated mono-alkyl glucose ether is represented in the above general formula, it is to be understood that any sugar ether, mono- or polyglycoside, etherified with a fatty acid chain containing at least 10 carbon atoms and finally acetylated can deliver these properties. In addition, any stable bond between the fatty chain and the sugar can be used. Such bonds include, but are not limited to, amide, thioether and urethane bonds, formed by conventional reactions. Also, instead of being acetylated, the remaining hydroxyl groups can be reacted with any reagent able to generate a labile bond.

The acetylated sugar ether of this embodiment is able to simultaneously deliver two major functions in a detergent composition, namely (1) bleach activation and (2) activated detergency. It is thus advantageous not only from a cost basis but also because it allows for an increase in formula concentration.

Although the acetylated sugar ethers of this invention can advantageously be employed in both powdered and aqueous liquid detergent compositions, other objects of the invention will become more apparent from the following detailed description of a preferred embodiment wherein a detergent composition is provided by adding to a non-aqueous liquid suspension an amount of acetylated sugar ether effective to provide the needed bleach activating, detergency boosting and fabric softening properties.

The nonionic synthetic organic detergents employed in the practice of the invention may be any of a wide variety of such compounds, which are well known and, for example, are described at length in the text *Surface Active Agents*, Vol. II, by Schwartz, Perry and Berch, published in 1958 by Interscience Publishers, and in McCutcheon's *Detergents and Emulsifiers*, 1969 Annual, the relevant disclosures of which are hereby incorporated by reference. Usually, the nonionic detergents are poly-lower alkoxylated lipophiles wherein the desired hydrophile-lipophile balance is obtained from addition of a hydrophilic poly-lower alkoxy group to a lipophilic moiety. A preferred class of the nonionic detergent employed is the poly-lower alkoxylated higher alkanol wherein the alkanol is of 10 to 18 carbon atoms and wherein the number of moles of lower alkylene oxide (of 2 or 3 carbon atoms) is from 3 to 12. Of such materials it is preferred to employ those wherein the higher alkanol is a higher fatty alcohol of 10 to 11 or 12 to 15 carbon atoms and which contain from 5 to 8 or 5 to 9 lower alkoxy groups per mole. Preferably, the lower alkoxy is ethoxy but in some instances, it may be desirably mixed with propoxy, the latter, if present, often being a minor (less that 50%) proportion. Exemplary of such compounds are those wherein the alkanol is of 12 to 15 carbon atoms and which contain about 7 ethylene oxide groups per mole e.g. Neodol 25-7 and Neodol 23-6.5, which products are made by Shell Chemical Company, Inc. The former is a condensation product of a mixture of higher fatty alcohols averaging about 12 to 15 carbon atoms, with about 7 moles of ethylene oxide and the latter is a corresponding mixture wherein the carbon atom content of the higher fatty alcohol is 12 to 13 and the number of ethylene oxide groups present averages about 6.5. The higher alcohols are primary alkanols. Other examples of such detergents include Tergitol 15-S-7 and Tergitol 15-S-9, both of which are linear secondary alcohol ethoxylates made by Union Carbide Corporation. The former is a mixed ethoxylation product of an 11 to 15 carbon atom linear secondary alkanol with seven moles of ethylene oxide and the latter is a similar product but with nine moles of ethylene oxide being reacted.

Also useful in the present composition as a component of the nonionic detergent are higher molecular weight nonionics, such as Neodol 45-11, which are similar ethylene oxide condensation products of higher fatty alcohols with the higher fatty alcohol being of 14 to 15 carbon atoms and the number of ethylene oxide groups per mole being about 11. Such products are also made by Shell Chemical Company.

An especially useful class of nonionics are represented by the commercially well known class of nonionics sold under the trademark Plurafac. The Plurafacs are the reaction product of a higher linear alcohol and a mixture of ethylene and propylene oxides, containing a mixed chain of ethylene oxide and propylene oxide, terminated by a hydroxyl group. Examples include Plurafac RA30, Plurafac RA40 (a $C_{13}$–$C_{15}$ fatty alcohol condensed with 7 moles propylene oxide and 4 moles ethylene oxide), Plurafac D25 (a $C_{13}$–$C_{15}$ fatty alcohol condensed with 5 moles propylene oxide and 10 moles ethylene oxide), Plurafac B26, and Plurafac RA50 (a mixture of equal parts Plurafac D25 and Plurafac RA40).

Generally, the mixed ethylene oxide-propylene oxide fatty alcohol condensation products can be represented by the general formula $$RO(C_2H_4O)_p(C_3H_6O)_qH$$

wherein R is a straight or branched, primary or secondary aliphatic hydrocarbon, preferably alkyl or alkenyl, especially preferably alkyl, of from 6 to 20, preferably 10 to 18, especially preferably 14 to 18 carbon atoms, p is a number of from 2 to 12, preferably 4 to 10, and q is a number of from 2 to 7, preferably 3 to 6. These surfactants are advantageously used where low foaming characteristics are desired. In addition they have the advantage of low gelling temperature.

Another group of liquid nonionics are available from Shell Chemical Company, Inc. under the Dobanol trademark: Dobanol 91-5 is an ethoxylated $C_9$–$C_{11}$ fatty alcohol with an average of 5 moles ethylene oxide; Dobanol 25-7 is an ethoxylated $C_{12}$–$C_{15}$ fatty alcohol with an average of 7 moles ethylene oxide.

In the preferred poly-lower alkoxylated higher alkanols, to obtain the best balance of hydrophilic and lipophilic moieties, the number of lower alkoxies will usually be from 40% to 100% of the number of carbon atoms in the higher alcohol, preferably 40% to 60% thereof and the nonionic detergent will preferably contain at least 50% of such poly-lower alkoxy higher alkanols. The alkyl groups are generally linear although branching may be tolerated, such as at a carbon next to or two carbons removed from the terminal carbon of the straight chain and away from the ethoxy chain, if such branched alkyl is not more than three carbons in length. Normally, the proportion of carbon atoms in such a branched configuration will be minor rarely exceeding 20% of the total carbon atom content of the alkyl. Similarly, although linear alkyls which are terminally joined to the ethylene oxide chains are highly preferred and are considered to result in the best combination of detergency and biodegradibility medial or secondary joinder to the ethylene oxide in the chain may occur. It is usually in only a minor proportion of such alkyls, generally less than 20% but, as is in the cases of the mentioned Tergitols, may be greater. Also, when propylene oxide is present in the lower alkylene oxide chain, it will usually be less than 20% thereof and preferably less than 10% thereof.

When greater proportions of non-terminally alkoxylated alkanols, propylene oxide-containing poly-lower alkoxylated alkanols and less hydrophile-lipophile balanced nonionic detergent than mentioned above are employed and when other nonionic detergents are used instead of the preferred nonionics recited herein, the product resulting may not have as good detergency, stability, and viscosity properties as the preferred compositions. In some cases, as when a higher molecular weight poly-lower alkoxylated higher alkanol is employed, often for its detergency, the proportion thereof will be regulated or limited in accordance with the results of routine experiments, to obtain the desired detergency. Also, it has been found that it is only rarely necessary to utilize the higher molecular weight nonionics for their detergent properties since the preferred nonionics described herein are excellent detergents and additionally, permit the attainment of the desired viscosity in the liquid detergent. Mixtures of two or more of these liquid nonionics can also be used.

Furthermore, in the compositions of this invention, it may often be advantageous to include compounds which function as viscosity control and gel-inhibiting agents for the liquid nonionic surface active agents such as low molecular weight ether compounds which can be considered to be analogous in chemical structure to the ethoxylated an/or propoxylated fatty alcohol nonionic surfactants but which have relatively short hydrocarbon chain lengths ($C_2$–$C_8$) and a low content of ethylene oxide (about 2 to 6 ethylene oxide units per molecule).

Suitable ether compounds can be represented by the following general formula $$RO(CH_2CH_2O)_nH$$

wherein R is a $C_2$–$C_8$ alkyl group, and n is a number of from about 1 to 6, on average.

Specific examples of suitable ether compounds include ethylene glycol monoethyl ether ($C_2H_5$—O—$CH_2CH_2OH$), diethylene glycol monobutyl ether ($C_4H_9$—O—$(CH_2CH_2O)_2H$), tetraethylene glycol monobutyl ether ($C_8H_{17}$—O—$(CH_2CH_2O)_4H$), etc. Diethylene glycol monobutyl ether is especially preferred.

Further improvements in the rheological properties of the liquid detergent compositions can be obtained by including in the composition a small amount of a nonionic surfactant which has been modified to convert a free hydroxyl group thereof to a moiety having a free carboxyl group. As disclosed in commonly assigned copending application Ser. No. 597,948, the disclosure of which is incorporated by reference, the free carboxyl group modified nonionic surfactants, which may be broadly characterized as polyether carboxylic acids, function to lower the temperature at which the liquid nonionic forms a gel with water. The acidic polyether compound can also decrease the yield stress of such dispersions, aiding in their dispensibility without a corresponding decrease in their stability against settling.

The invention detergent compositions also include water soluble and/or water insoluble detergent builder salts. Typical suitable builders include, for example, those disclosed in U.S. Pat. Nos. 4,316,812; 4,264,466 and 3,630,929. Water soluble inorganic alkaline builder salts which can be used along with the detergent compound or in admixture with other builders are alkali metal carbonates, borates, phosphates, polyphosphates, bicarbonates, and silicates. Ammonium or substituted ammonium salts can also be used. Specific examples of such salts are sodium tripolyphosphate, sodium carbonate, sodium tetraborate, sodium pyrophosphate, potassium pyrophosphate, sodium hexametaphosphate, and potassium bicarbonate. Sodium tripolyphosphate (TPP) is especially preferred. The alkali metal silicates are useful builder salts which also function to make the composition anticorrosive to washing machine parts. Sodium silicates of $Na_2O/SiO_2$ ratios of from 1.6/1 to 1/3.2, especially about ½ to 1/2.8 are preferred. Potassium silicates of the same can also be used.

Another class of builders highly useful herein are the water insoluble aluminosilicates, both of the crystalline and amorphous type. Various crystalline zeolites (i.e. aluminosilicates) are described in British Patent No. 1,504,168, U.S. Pat. No. 4,409,136 and Canadian Patent Nos. 1,072,835 and 1,087,477. An example of amorphous zeolites useful herein can be found in Belgium Patent 835,351. The zeolites generally have the formula $$(M_2O)_x\cdot(Al_2O_3)_y\cdot(SiO_2)_z\cdot WH_2O$$

where x is 1, y is from 0.8 to 1.2 and preferably 1, z is from 1.5 to 3.5 or higher and preferably 2 to 3 and W is from 0 to 9, preferably 2.5 to 6 and M is preferably sodium. A typical zeolite is type A or similar structure, with type 4A particularly preferred. The preferred aluminosilicates have calcium ion exchange capacities of about 200 milliequivalents per gram or greater, e.g. 400 meq/g.

Other materials such as clays, particularly of the water insoluble types, may be useful adjuncts in compositions of this invention. Particularly useful is bentonite. This material is primarily montmorillonite which is a hydrated aluminum silicate in which about 1/6th of the aluminum atoms may be replaced by magnesium atoms and with which varying amounts of hydrogen, sodium, potassium, calcium, etc., may be loosely combined. The bentonite in its more purified form (i.e. free from grit, sand, etc.) suitable for detergents invariably contains at least 50% montmorillonite and thus its cation exchange capacity is at least about 50 to 75 meq per 100 g of bentonite. Particularly preferred bentonites are the Wyoming or Western U.S. bentonites which have been sold as Thixo-jels 1, 2, 3 and 4 by Georgia Kaolin Co. These bentonites are known to soften textiles as described in British Patent Nos. 401,413 and 461,221.

Examples of organic alkaline sequestrant builder salts which can be used along with the detergent or in admixture with other organic and inorganic builders are alkali metal, ammonium or substituted ammonium, aminopolycarboxylates, e.g. sodium and potassium nitrilotriacetates (NTA) and triethanolammonium N-(2-hydroxyethyl)$_n$itrileodiacetates. Mixed salts of these polycarboxylates are also suitable.

Other suitable builders of the organic type include carboxymethylsuccinates, tartronates and glycollates. Of special value are the polyacetal carboxylates. The polyacetal carboxylates and their use in detergent compositions are described in U.S. Pat. Nos. 4,144,226; 4,315,092 and 4,146,495. Other U.S. patents on similar builders include U.S. Pat. Nos. 4,141,676; 4,169,934; 4,201,858; 4,204,852; 4,224,420; 4,225,685; 4,226,960; 4,233,422; 4,233,423; 4,302,564 and 4,303,777. Also relevant are European Patent Application Nos. 0,015,024; 0,021,491 and 0,063,399.

Since the compositions of this invention are generally highly concentrated, and, therefore, may be used at relatively low dosages, it is desirable to supplement any phosphate builder (such as sodium tripolyphosphate) with an auxilliary builder such as a polymeric carboxylic acid having high calcium binding capacity to inhibit incrustation which could otherwise be caused by formation of an insoluble calcium phosphate. Such auxiliary builders are also well known in the art. For example, mention can be made of Sokolan CP5 which is a copolymer of about equal moles of methacrylic acid and maleic anhydride, completely neutralized to form the sodium salt thereof.

In addition to detergent builders, various other detergent additives or adjuvants may be present in the detergent product to give it additional desired properties, either of functional or aesthetic nature. Thus, there may be included in the formulation, minor amounts of soil suspending or antiredeposition agents, e.g. polyvinyl alcohol, fatty amides, sodium carboxymethyl cellulose, hydroxy-propyl alcohol methyl cellulose; optical brighteners, e.g. cotton, polyamide and polyester brighteners, for example, stilbene, triazole and benzidine sulfone compositions, especially sulfonated substituted triazinyl stilbene, sulfonated naphthotriazole stilbene, benzidene sulfone, etc., most preferred are stilbene and triazole combinations.

Bluing agents such as ultramarine blue; enzymes, preferably proteolytic enzymes, such as subtilisin, bromelin, papain, trypsin and pepsin, as well as amylase type enzymes, lipase type enzymes, and mixtures thereof; bactericides, e.g. tetrachlorosalicylanilide, hexachlorophene; fungicides; dyes; pigments (water dispersible); preservatives; ultraviolet absorbers; anti-yellowing agents, such as sodium carboxymethyl cellulose (CMC), complex of $C_{12}$ to $C_{22}$ alkyl alcohol with $C_{12}$ to $C_{18}$ alkylsulfate; pH modifiers and pH buffers;

perfume; and anti-foam agents or suds-suppressors, e.g. silicon compounds can also be used.

As described hereinabove, bleaching agents are classified broadly for convenience as chlorine bleaches and oxygen bleaches Oxygen bleaches being preferred. The perborates, particularly sodium perborate monohydrate, are especially preferred. In accordance with this invention, the peroxygen compound is used in admixture with an acetylated sugar ether which functions as an activator therefor. In addition, the detergency properties of the nonionic detergent is improved by the presence of the acetylated sugar ether of the invention.

In a preferred form of the invention, the mixture of liquid nonionic surfactant and solid ingredients is subjected to an attrition type of mill in which the particle sizes of the solid ingredients are reduced to less than about 10 microns, e.g. to an average particle size of 2 to 10 microns or even lower (e.g. 1 micron). Preferably less than about 10%, especially less than about 5% of all the suspended particles have particle sizes greater than 10 microns, compositions whose dispersed particles are of such small size have improved stability against separation or settling on storage.

In the grinding operation, it is preferred that the proportion of solid ingredients be high enough (e.g. at least about 40% such as about 50%) that the solid particles are in contact with each other and are not substantially shielded from one another by the nonionic surfactant liquid. Mills which employ grinding balls (ball mills) or similar mill grinding elements have given very good results. Thus, one may use a laboratory batch attritor having 8 mm diameter steatite grinding balls For larger scale work a continuously operating mill in which there are 1 mm or 1.5 mm diameter grinding balls working in a very small gap between a stator and a rotor operating at a relatively high speed (e.g. CoBall mill) may be employed. When using such a mill, it is desirable to pass the blend of nonionic surfactant and solids first through a mill which does not effect such fine grinding (e.g. a colloid mill) to reduce the particle size to less than 100 microns (e.g. to about 40 microns) prior to the step of grinding to an average particle diameter below about 10 microns in the continuous ball mill.

In the preferred heavy duty liquid detergent compositions of the invention, typical proportions (based on the total composition, unless otherwise specified) of the ingredients are as follows:

Suspended detergent builder, within the range of about 10 to 60% such as about 20 to 50%, e.g. about 25 to 40%.

Liquid phase comprising nonionic surfactant and optionally dissolved gel-inhibiting ether compound, within the range of about 30 to 70%, such as about 40 to 60%; this phase may also include minor amounts of a diluent such as a glycol, e.g. polyethylene glycol (e.g. "PEG 400"), hexylene glycol, etc. such as up to 10%, preferably up to 5%, for example, 0.5% to 2%. The weight ratio of nonionic surfactant to ether compound when the latter is present is in the range of from about 100:1 to 1:1, preferably from about 50:1 to about 2:1.

Acetylated sugar ether of this invention, from about 4% to about 15%, preferably about 6 to about 8%.

Polyether carboxylic acid gel-inhibiting compound, up to an amount to supply in the range of about 0.5 to 10 parts (e.g. about 1 to 6 parts, such as about 2 to 5 parts) of —COOH (M.W. 45) per 100 parts of blend of such acid compound and nonionic surfactant. Typically, the amount of the polyether carboxylic acid compound is in the range of about 0.05 to 0.6 part, e.g. about 0.2 to 0.5 part, per part of the nonionic surfactant.

Acidic organic phosphoric acid compound, as anti-settling agent; up to 5%, for example, in the range of 0.01 to 5%, such as about 0.05 to 2%, e.g. about 0.1 to 1%.

Suitable ranges of the optional detergent additives are: enzymes—0 to 2%, especially 0.7 to 1.3%; corrosion inhibitors—about 0 to 40%, and preferable 5 to 30%; anti-foam agents and suds-suppressors—0 to 15%, preferably 0 to 5%, for example 0.1 to 3%; thickening agent and dispersants—0 to 15%, for example 0.1 to 15%, for example 0.1 to 10%, preferably 1 to 5%; soil suspending or anti-redeposition agents and anti-yellowing agents—0 to 10%, preferably 0.5 to 5%; colorants, perfumes, brighteners and bluing agents total weight 0% to about 2% and preferably 0% to about 2% and preferably 0% to about 1%; pH modifiers and pH buffers—0 to 5% preferably 0 to 2%; bleaching agent—0% to about 40% and preferable 0% to about 25%, for example 2 to 20%. In the selections of the adjuvants, they will be chosen to be compatible with the main constituents of the detergent composition.

In this application, all proportions and percentages are by weight unless otherwise indicated. In the examples, atmospheric pressure is used unless otherwise indicated.

EXAMPLE

A concentrated non-aqueous built liquid detergent composition is formulated from the following ingredients in the amounts specified. The composition is prepared by mixing and finely grinding the following ingredients to produce a liquid suspension. In preparing the mixture for grinding the solid ingredients are added to the nonionic surfactant, with TPP being added last.

| | Amount Weight % |
|---|---|
| Nonionic surfactant (ethoxylated-propoxylated C13–C15 fatty alcohol) | 23 |
| Dowanol DB - nonionic surfactant | 21 |
| Mono (C-12) alkyl glucose ether, tetra acetyl | 6 |
| Sodium tripolyphosphate (TPP) - builder salt | 33.8 |
| Sokalan CP5 - anti-encrustation agent | 2 |
| Dequest 2066 - sequestering agent | 1 |
| Sodium perborate monohydrate - bleaching agent | 9 |
| Urea - stabilizer | 1 |
| Sodium carboxymethylcellulose (CMC) - anti-yellowing agent | 1 |
| Esperase - enzyme | 0.8 |
| Termamyl - enzyme | 0.2 |
| Tinopal ATS-X - optical brightener | 0.4 |
| $TiO_2$ - whitening agent | 0.2 |
| Perfume | 0.6 |

The above composition is stable in storage, dispenses readily in cold wash water and exhibits excellent detersive effects to the wash load.

It is to be understood that the foregoing detailed description is given merely by way of illustration and that variations may be made therein without departing from the spirit and scope of the invention.

What is claimed is:

1. A heavy duty laundry detergent composition comprising a detersively effective amount of a nonionic surfactant, a bleaching effective amount of a bleaching agent and, as a bleach activator and detergency booster, a bleach activating and a detergency boosting effective amount of an acetylated sugar ether containing a long chain alkyl group containing at least 10 carbon atoms.

2. The composition of claim 1 wherein the acetylated sugar ether is acetylated glucose ether.

3. A heavy duty laundry detergent composition comprising a detersively effective amount of a nonionic surfactant, a bleaching effective amount of a bleaching agent, and, as a bleach activator and detergency booster, a bleach activating and a detergency boosting effective amount of an acetylated glucose ether containing a long chain alkyl group containing at least 10 carbon atoms wherein the acetylated glucose ether is tetraacetyl mono-alkyl glucose.

4. The composition of claim 1 wherein the bleaching agent is sodium perborate monohydrate.

5. The composition of claim 1 wherein said alkyl group contains 12–22 carbon atoms.

6. The composition of claim 1 wherein the heavy duty laundry detergent composition is in powdered form.

7. The composition of claim 1 wherein the heavy duty laundry detergent composition is in liquid form.

8. The composition of claim 7 wherein the heavy duty liquid composition is a non-aqueous liquid composition.

9. A non-aqueous heavy duty laundry composition comprising a suspension of a detergent building effective amount of insoluble particles of builder salt, a bleaching effective amount of a bleaching agent and, as a bleach and detergency booster, a bleach activating and detergency boosting effective amount of an acetylated sugar ether containing a long chain alkyl group containing at least 10 carbon atoms dispersed in a detersively effective amount of a liquid nonionic surfactant.

10. The composition of claim 11 wherein the acetylated sugar ether is acetylated glucose ether.

11. A non-aqueous heavy duty laundry composition comprising a suspension of a detergent building effective amount of insoluble particles of builder salt, a bleaching effective amount of a bleaching agent, and, as a bleach activator and detergency booster, a bleach activating and detergency boosting effective amount of an acetylated glucose ether containing a long chain alkyl group containing at least 10 carbon atoms, dispersed in a detersively effective amount of a liquid nonionic surfactant, wherein the acetylated glucose ether is tetraacetyl mono-alkyl glucose.

12. The composition of claim 9 wherein the bleaching agent is sodium perborate monohydrate.

13. The composition of claim 9 wherein said alkyl group contain at least 12 carbon atoms.

* * * * *